US009149079B1

(12) United States Patent
Burke

(10) Patent No.: US 9,149,079 B1
(45) Date of Patent: Oct. 6, 2015

(54) PANTS WITH INTEGRATED GOLF POCKET

(71) Applicant: Kevin Burke, Peterborough, NH (US)

(72) Inventor: Kevin Burke, Peterborough, NH (US)

( * ) Notice: Subject to any disclaimer, the term of this patent is extended or adjusted under 35 U.S.C. 154(b) by 0 days.

(21) Appl. No.: 14/270,481

(22) Filed: May 6, 2014

(51) Int. Cl.
*A41D 27/20* (2006.01)
*A41D 13/00* (2006.01)
*A41D 27/12* (2006.01)

(52) U.S. Cl.
CPC ..... *A41D 27/12* (2013.01); *A41D 13/0012* (2013.01); *A41D 27/20* (2013.01)

(58) Field of Classification Search
CPC . Y10S 224/918; Y10S 224/919; A41D 27/20; A41D 13/0012; A41D 27/08; A41D 1/08; A41D 13/0015; A41D 13/04; A63B 57/00; A63B 57/0031; A63B 47/001; A63B 57/0075; A63B 55/008; A63B 2243/0029; A63B 55/02; A45F 5/022; A45C 13/02; A45C 11/182; A45C 11/18; A45C 11/00
See application file for complete search history.

(56) References Cited

U.S. PATENT DOCUMENTS 530,542 A * 12/1894 Mahon ..... 2/252
581,655 A * 4/1897 Burger ..... 24/12
1,161,435 A * 11/1915 Baker ..... 2/253
1,176,266 A * 3/1916 Batchelder ..... 224/681
1,194,335 A * 8/1916 Jennings ..... 224/682
1,212,639 A * 1/1917 Hester ..... 2/253
1,683,996 A * 9/1928 Snow ..... 150/147
1,719,244 A * 7/1929 Shirk ..... 2/250
1,764,483 A * 6/1930 Watkins ..... 2/247
1,806,797 A * 5/1931 Guiterman ..... 2/250
1,970,110 A * 8/1934 Vaccaro ..... 2/247
2,312,177 A * 2/1943 Lester ..... 2/253
2,537,701 A * 1/1951 Previdi ..... 2/94
2,558,382 A * 6/1951 Previdi ..... 224/223
D165,253 S * 11/1951 Ward ..... D3/224
2,665,830 A * 1/1954 Fowler ..... 224/247
2,682,981 A * 7/1954 Previdi ..... 224/223
3,058,506 A * 10/1962 Parisi ..... 150/133
3,320,620 A * 5/1967 Weidler et al. ..... 2/250
3,688,315 A * 9/1972 Helmur ..... 2/252
3,753,519 A * 8/1973 Gammon ..... 206/223
3,799,331 A * 3/1974 White ..... 206/38
3,819,095 A * 6/1974 Snyder ..... 224/248
3,968,522 A * 7/1976 Riess ..... 2/250
4,129,237 A * 12/1978 Grinder ..... 224/669
4,151,937 A * 5/1979 Jarosh et al. ..... 224/666
4,266,300 A * 5/1981 Partridge ..... 2/247
4,444,342 A * 4/1984 Powell ..... 224/667
D274,830 S * 7/1984 Lynch ..... D3/224
D277,900 S * 3/1985 Reed ..... D3/224
4,512,504 A * 4/1985 Owlett ..... 224/572
4,705,086 A * 11/1987 O'Neill ..... 150/134
4,736,877 A * 4/1988 Clark ..... 224/666
4,741,372 A * 5/1988 Santilli ..... 150/137
4,852,782 A * 8/1989 Wu et al. ..... 224/661
4,886,196 A * 12/1989 Plummer ..... 224/235
4,893,739 A * 1/1990 Conner ..... 224/240
4,903,745 A * 2/1990 Roman ..... 150/134
5,024,361 A * 6/1991 Flowers ..... 224/223
5,031,812 A * 7/1991 Gustine ..... 224/191
5,050,830 A * 9/1991 Hall ..... 248/205.2

(Continued)

*Primary Examiner* — Bobby Muromoto, Jr.
(74) *Attorney, Agent, or Firm* — Kyle A. Fletcher, Esq.

(57) ABSTRACT

The pouch assembly for being selectively positionable in an article of clothing includes a panel that may be removably inserted into a pocket in the article of clothing. A pouch portion of the panel may insertably receive an object. The pouch is ideally suited for use in storing objects related to golf.

15 Claims, 5 Drawing Sheets

(56) References Cited

U.S. PATENT DOCUMENTS

| | | | | | |
|---|---|---|---|---|---|
| 5,054,777 | A * | 10/1991 | Borden et al. | 473/406 |
| D323,067 | S * | 1/1992 | Palma | D3/224 |
| 5,114,061 | A * | 5/1992 | Brady | 224/669 |
| 5,199,573 | A * | 4/1993 | Gribovsky | 206/579 |
| 5,269,410 | A * | 12/1993 | Abregano | 206/315.5 |
| D345,859 | S * | 4/1994 | Gribovsky | D3/247 |
| D346,493 | S * | 5/1994 | Nichols | D3/224 |
| 5,341,975 | A * | 8/1994 | Marinescu | 224/666 |
| 5,517,696 | A * | 5/1996 | Krugler | 2/250 |
| 5,772,090 | A * | 6/1998 | Rodriguez | 224/251 |
| 5,775,398 | A * | 7/1998 | Siegel | 150/139 |
| 5,799,853 | A * | 9/1998 | Brewster | 224/679 |
| 5,934,530 | A * | 8/1999 | Antczak et al. | 224/197 |
| 6,102,201 | A * | 8/2000 | Marston et al. | 206/315.1 |
| 6,148,443 | A * | 11/2000 | Maastricht | 2/69 |
| 6,202,911 | B1 * | 3/2001 | Freer | 224/684 |
| D464,193 | S * | 10/2002 | Leung | D3/221 |
| 6,491,074 | B1 * | 12/2002 | Roegner | 150/112 |
| D473,049 | S * | 4/2003 | Devine | D3/228 |
| 6,543,063 | B2 * | 4/2003 | Greer | 2/239 |
| 6,619,349 | B2 * | 9/2003 | Gribovsky | 150/135 |
| 6,634,528 | B2 * | 10/2003 | Hurtgam | 224/251 |
| 6,659,321 | B2 * | 12/2003 | Hartranft et al. | 224/683 |
| D486,636 | S * | 2/2004 | Rudeen et al. | D3/221 |
| 6,691,323 | B2 * | 2/2004 | Widmer | 2/247 |
| 6,823,909 | B1 * | 11/2004 | Marsteller | 150/113 |
| 6,839,917 | B1 * | 1/2005 | Landwehr | 2/455 |
| D504,483 | S * | 4/2005 | Leung | D3/221 |
| 6,889,828 | B2 * | 5/2005 | Pursely | 206/315.1 |
| D508,807 | S * | 8/2005 | Berger | D6/500 |
| 7,854,021 | B2 * | 12/2010 | Compton et al. | 2/249 |
| 8,573,457 | B1 * | 11/2013 | Morgan | 224/673 |
| 2001/0035319 | A1 * | 11/2001 | Clements et al. | 190/109 |
| 2004/0016787 | A1 * | 1/2004 | Ioime | 224/669 |
| 2005/0144826 | A1 * | 7/2005 | Murphy | 40/641 |
| 2006/0169731 | A1 * | 8/2006 | Matulewic | 224/674 |
| 2007/0271829 | A1 * | 11/2007 | Knight | 40/654.01 |
| 2008/0178507 | A1 * | 7/2008 | Dean-McLeod | 40/661 |
| 2008/0216373 | A1 * | 9/2008 | Rivera et al. | 40/661 |
| 2008/0232720 | A1 * | 9/2008 | Karagiannis | 383/22 |
| 2011/0210022 | A1 * | 9/2011 | Degel | 206/232 |

* cited by examiner

PANTS WITH INTEGRATED GOLF POCKET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of clothing, more specifically, pants with a pocket specially suited for a golfer.

SUMMARY OF THE INVENTION

An embodiment of the disclosure meets the needs presented above by generally comprising a panel that may be removably inserted into a pocket in the article of clothing. A pouch portion of the panel may insertably receive an object.

These together with additional objects, features and advantages of the pants with integrated golf pocket will be readily apparent to those of ordinary skill in the art upon reading the following detailed description of presently preferred, but nonetheless illustrative, embodiments of the XXX when taken in conjunction with the accompanying drawings.

In this respect, before explaining the current embodiments of the XXX in detail, it is to be understood that the XXX is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of XXX.

It is therefore important that the claims be regarded as including such equivalent construction insofar as they do not depart from the spirit and scope of XXX. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
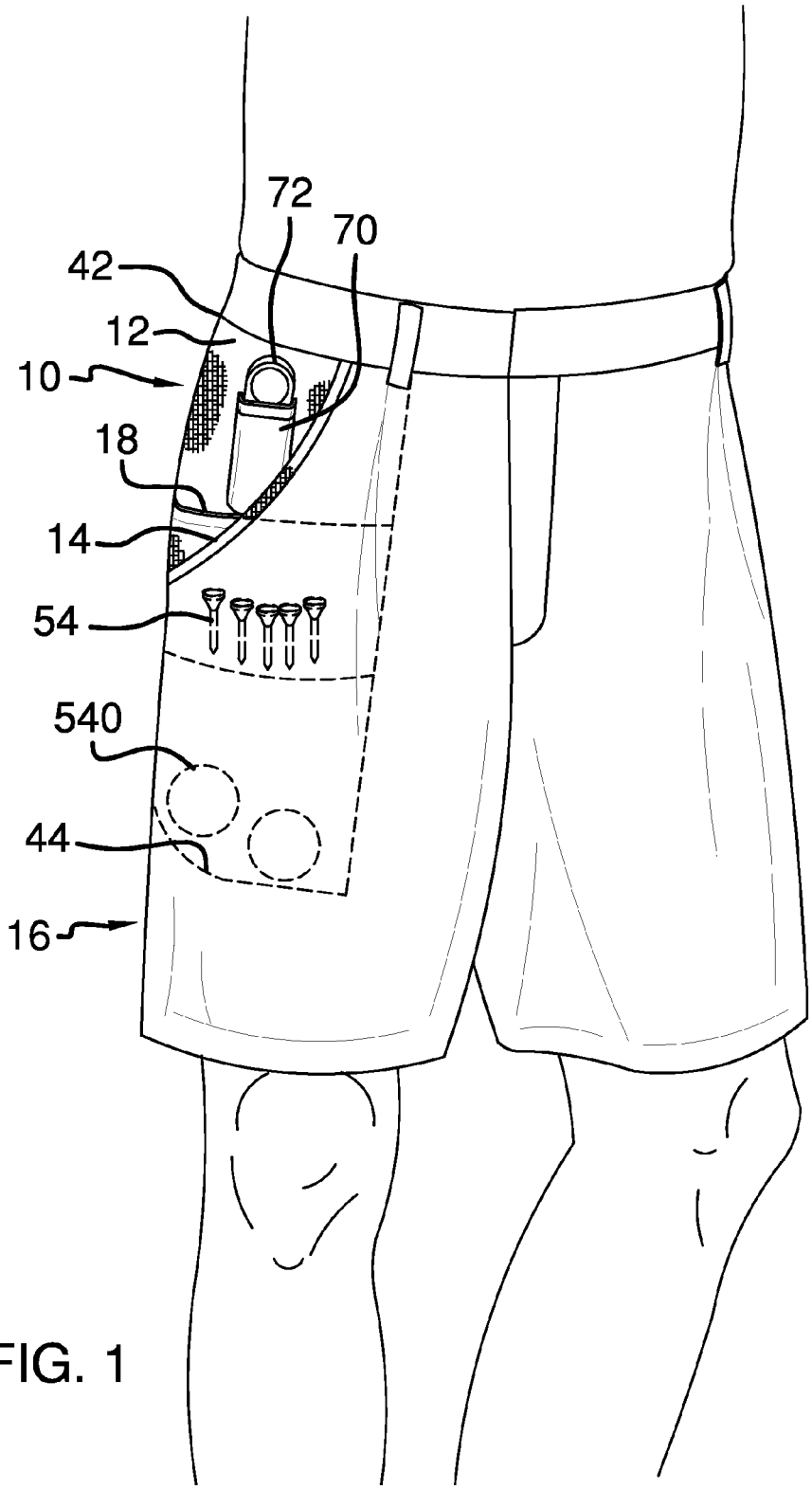
FIG. 1 is an in-use view of a pouch assembly according to an embodiment of the disclosure.
Figure 2:
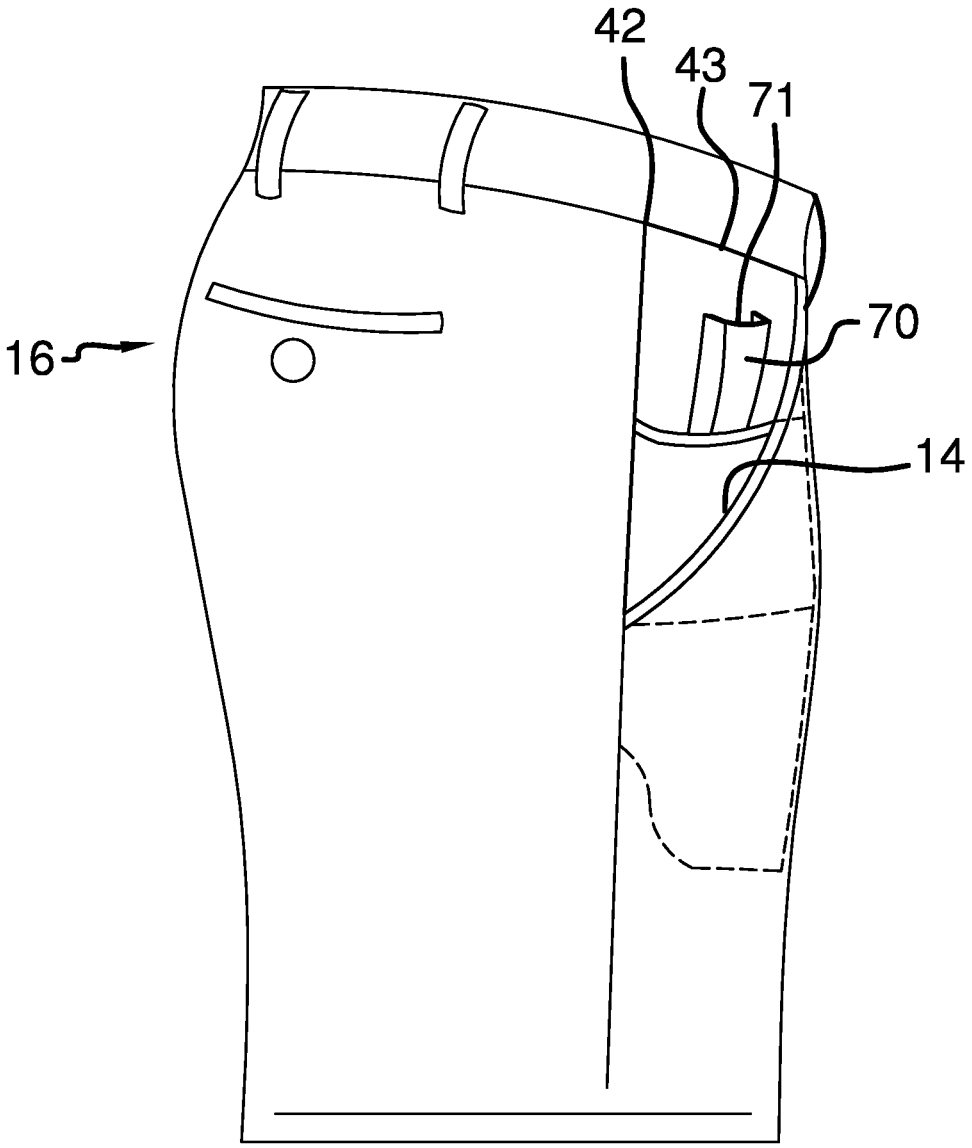
FIG. 2 is a right side view of an embodiment of the disclosure.
Figure 3:
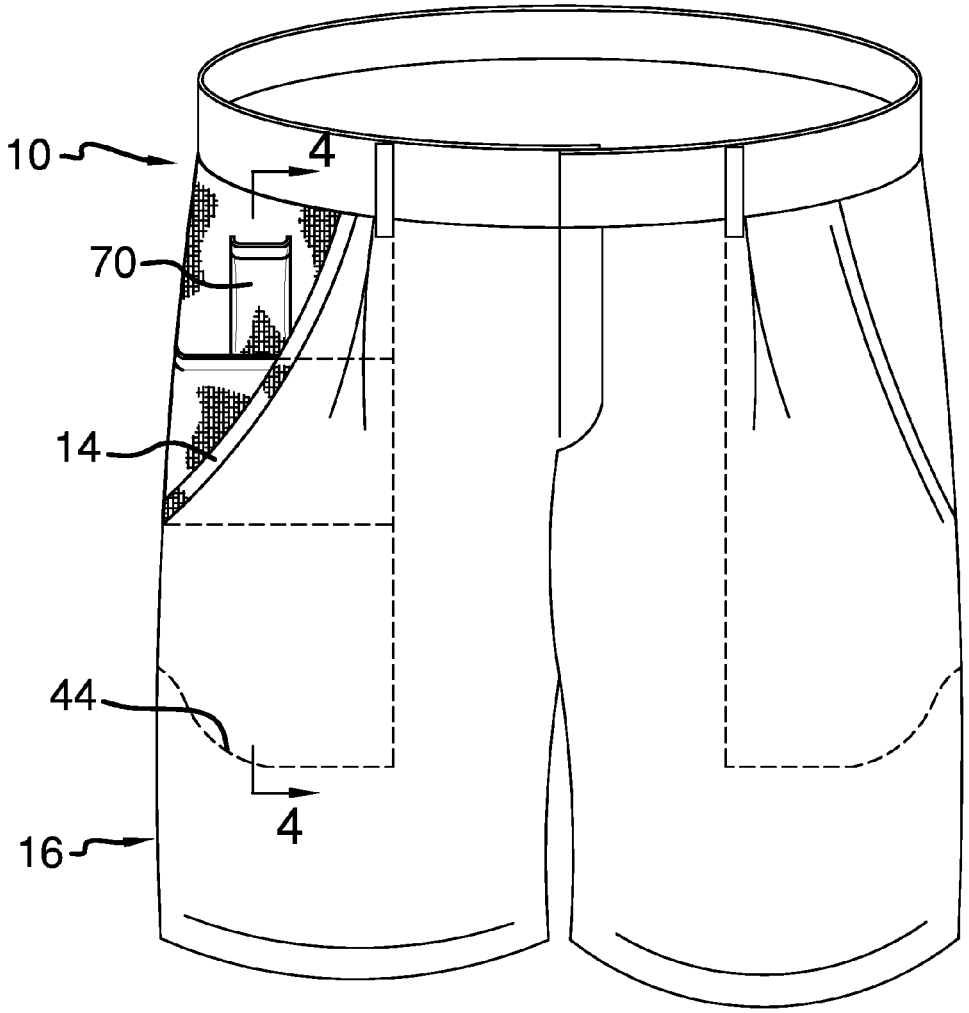
FIG. 3 is a front view of an embodiment of the disclosure.
Figure 4:
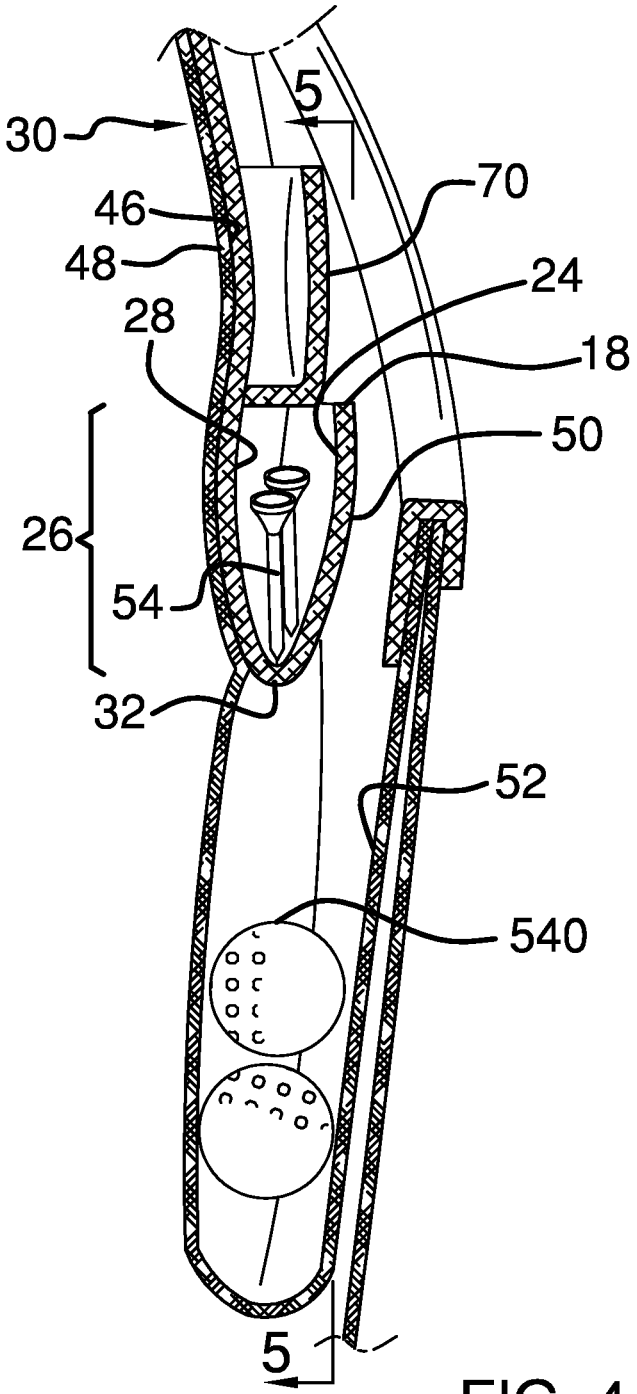
FIG. 4 is a cross sectional view taken along line 4-4 of FIG. 3 of an embodiment of the disclosure.
Figure 5:
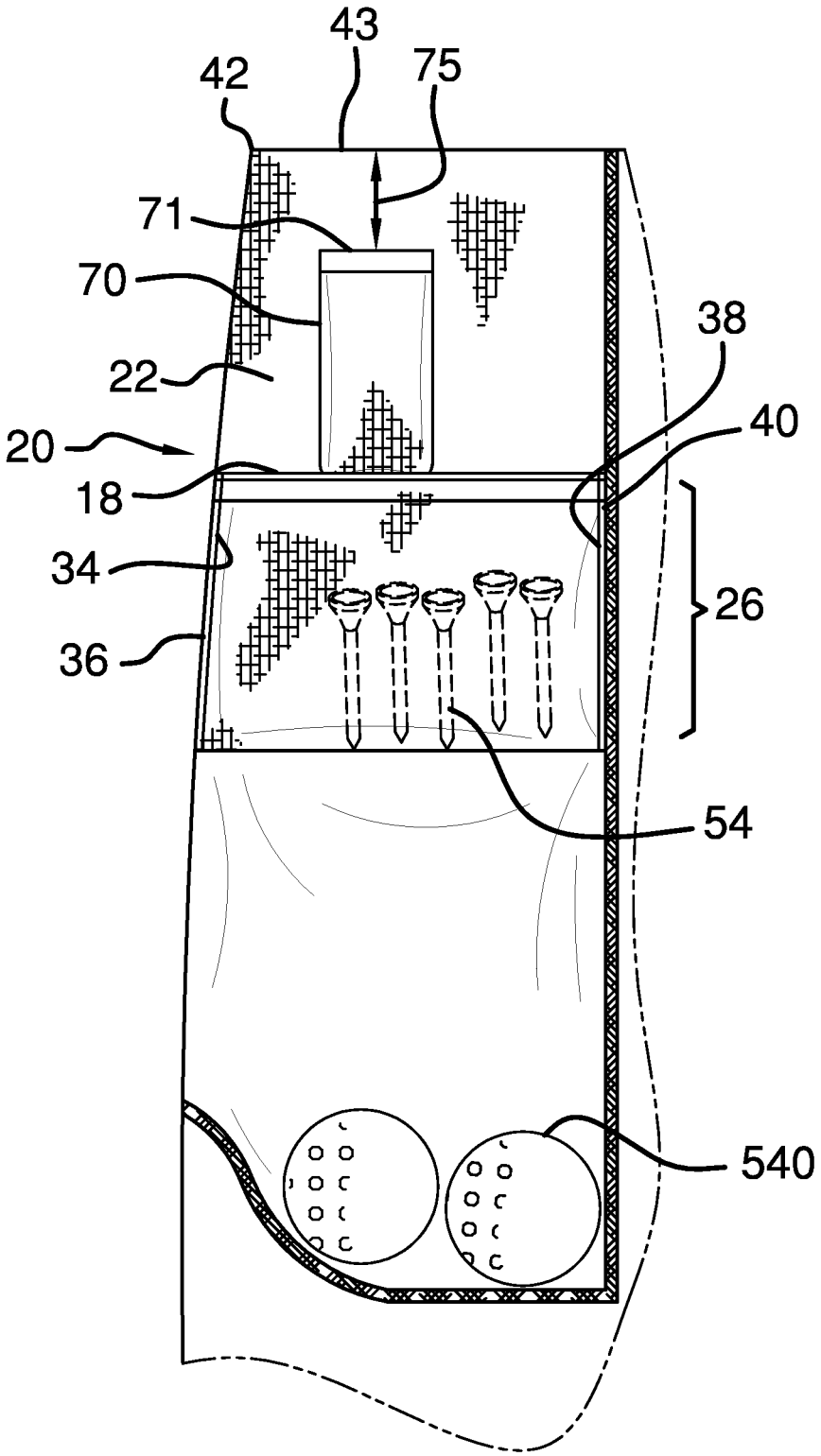
FIG. 5 is a cross-sectional view taken along line 5-5 in FIG. 4 of an embodiment of the disclosure.

As best illustrated in FIGS. 1 through 5, the pouch assembly 10 generally comprises a panel 12 that may be removably inserted into a pocket 14 in an article of clothing 16. The article of clothing 16 may be a pair of pants or a pair of shorts of any conventional design. Additionally, the pocket 14 may be a front pocket in the article of clothing 16. The panel 12 may be comprised of a resiliently deformable material such as neoprene or other similar material.

The panel 12 has a width that is less than a height of the panel 12. Additionally, the panel 12 has a rectangular shape that may have a width between 10 cm and 13 cm. Further, the panel 12 may have a height between 15 cm and 20 cm. Lastly, the panel 12 may have a thickness between 1 mm and 3 mm.

A bottom edge 18 of the panel 12 is folded upwardly toward a middle 20 of a front side 22 of the panel 12. Moreover, a rear surface 24 of a folded portion 26 of the panel 12 is positioned proximate a front surface 28 of a flat portion 30 of the panel 12. The folded portion 26 of the panel 12 is defined proximate a bottom 32 of the flat portion 30 of the panel 12. Lastly, the folded portion 26 of the panel 12 may have a height between 5 cm and 8 cm.

A first lateral edge 34 of the folded portion 26 of the panel 12 is coupled to a first lateral edge 36 of the flat portion 30 of the panel 12. Continuing, a second lateral edge 38 of the folded portion 26 of the panel 12 is coupled to a second lateral edge 40 of the flat portion 30 of the panel 12. The folded portion 26 of the panel 12 may be sewn to the flat portion 30 of the panel 12.

The panel 12 is positionable in the pocket 14 in the article of clothing 16. Moreover, the panel 12 is coextensive with the pocket 14 in the article of the clothing 16. An upper first lateral corner 42 of the panel 12 is exposed when the panel 12 is positioned within the pocket 14 in the article of clothing 16. The first lateral corner 42 defines a distal end of a top panel edge 43 that defines the topmost portion of the panel 12 of the assembly 10.

The folded portion 26 of the panel 12 is positioned proximate a bottom 44 of the pocket 14 in the article of clothing 16. A back side 46 of the panel 12 abuts a back side 48 of the pocket 14 in the article of clothing 16. Further, a front side 50 of the folded portion 26 of the panel 12 abuts a front side 52 of the pocket 14 in the article of clothing 16.

An object 54 is inserted through an open top end 56 of the folded portion 26 of the panel 12. Moreover, the object 54 is selectively stored in the folded portion 26 of the panel 12. The object 54 is discrete from the pocket 14 in the article of clothing 16. Lastly, the object 54 may be a golf tee or other object related to the game of golf. It shall be noted that a secondary object 540 may be inserted into the pocket 14 of the article of clothing 16. The secondary object 540 may be a golf ball.

The assembly 10 is further defined with a divot repair pocket 70 that is also included on the front side 22 of the panel 12. Moreover, the divot repair pocket 70 is configured to store a divot repair tool 72 therein. The divot repair pocket 70 is positioned above the folded portion 26 so as to not interfere with the use of the folded portion 26. The divot repair pocket 70 is further defined with a tool opening 71 that is oriented upwardly, and enables the divot repair tool 72 to slide into from above the divot repair pocket 70. The tool opening 71 is provided beneath the top panel edge 43 by a divot repair pocket distance 75.

In use, the panel 12 is positioned within the pocket 14 in the article of clothing during play of the game of golf. The object 54 is stored within the folded portion 26 of the panel 12. Moreover, the panel 12 prevents the object 54 from soiling the pocket 14 in the article of the clothing 16. The panel 12 is removed from the pocket 14 in the article of clothing 16 after the game is completed. Lastly, the panel 12 is cleaned after the panel 12 is removed from the pocket 14 in the article of clothing 16.

With respect to the above description, it is to be realized that the optimum dimensional relationship for the various components of the pouch assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the pouch assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A pouch assembly for being selectively positionable in an article of clothing, said assembly comprising:

a panel configured be removably inserted into a pocket in the article of clothing;

wherein said panel having a width being less than a height of said panel;

wherein said panel being positionable in the pocket in the article of clothing; wherein a folded portion of said panel is positioned proximate a bottom of the pocket in the article of clothing; wherein the panel is coextensive with the pocket in the article of the clothing; wherein an upper first lateral corner of the panel is exposed when the panel is positioned within the pocket in the article of clothing; wherein the first lateral corner defines a distal end of a top panel edge that defines the topmost portion of the panel;

wherein a front side of said folded portion of said panel abuts a front side of the pocket in the article of clothing;

wherein an object is adapted to be inserted through an open top end of a folded portion of said panel.

2. The assembly according to claim 1 wherein said panel has a rectangular shape.

3. The assembly according to claim 1 wherein a bottom edge of said panel being folded upwardly toward a middle of a front side of said panel.

4. The assembly according to claim 3 wherein an rear surface of a folded portion of said panel is positioned proximate a front surface of a flat portion of said panel.

5. The assembly according to claim 3 wherein a folded portion of said panel is defined proximate a bottom of a flat portion of said panel.

6. The assembly according to claim 1 wherein a first lateral edge of a folded portion of said panel being coupled to a first lateral edge of a flat portion of said panel.

7. The assembly according to claim 1 wherein a second lateral edge of a folded portion of said panel being coupled to a second lateral edge of a flat portion of said panel.

8. The assembly according to claim 1 wherein a back side of said panel abuts a back side of the pocket in the article of clothing.

9. The assembly according to claim 1 wherein the object is selectively stored in said folded portion of said panel.

10. The assembly according to claim 9 wherein the object is discrete from the pocket in the article of clothing.

11. The assembly according to claim 10 wherein the assembly is further defined with a divot repair pocket that is also included on the front side of the panel; wherein the divot repair pocket is configured to store a divot repair tool therein; wherein the divot repair pocket is positioned above the folded portion so as to not interfere with the use of the folded portion; wherein the divot repair pocket is further defined with a tool opening that is oriented upwardly, and enables the divot repair tool to slide into from above the divot repair pocket; wherein the tool opening is provided beneath the top panel edge by a divot repair pocket distance.

12. A pouch assembly for being selectively positionable in an article of clothing, said assembly comprising:

a panel configured be removably inserted into a pocket in the article of clothing; and wherein said panel having a width being less than a height of said panel wherein said panel has a rectangular shape;

wherein a bottom edge of said panel being folded upwardly toward a middle of a front side of said panel wherein an rear surface of a folded portion of said panel is positioned proximate a front surface of a flat portion of said panel; wherein said folded portion of said panel is defined proximate a bottom of said flat portion of said panel;

wherein an object is adapted to be inserted through an open top end of a folded portion of said panel wherein the object is selectively stored in said folded portion of said panel wherein the object is discrete from the pocket in the article of clothing.

13. The assembly according to claim 12 wherein a first lateral edge of a folded portion of said panel being coupled to a first lateral edge of a flat portion of said panel; a second lateral edge of a folded portion of said panel being coupled to a second lateral edge of a flat portion of said panel.

14. The assembly according to claim 13 wherein said panel being positionable in the pocket in the article of clothing; wherein a folded portion of said panel is positioned proximate a bottom of the pocket in the article of clothing; wherein the panel is coextensive with the pocket in the article of the clothing; wherein an upper first lateral corner of the panel is exposed when the panel is positioned within the pocket in the article of clothing; wherein the first lateral corner defines a distal end of a top panel edge that defines the topmost portion of the panel; wherein a folded portion of said panel is positioned proximate a bottom of the pocket in the article of clothing wherein a back side of said panel abuts a back side of the pocket in the article of clothing wherein a front side of said folded portion of said panel abuts a front side of the pocket in the article of clothing.

15. The assembly according to claim 14 wherein the assembly is further defined with a divot repair pocket that is also included on the front side of the panel; wherein the divot repair pocket is configured to store a divot repair tool therein; wherein the divot repair pocket is positioned above the folded portion so as to not interfere with the use of the folded portion; wherein the divot repair pocket is further defined with a tool opening that is oriented upwardly, and enables the divot repair tool to slide into from above the divot repair pocket; wherein the tool opening is provided beneath the top panel edge by a divot repair pocket distance.

* * * * *